US010119530B2

(12) United States Patent
Kim

(10) Patent No.: US 10,119,530 B2
(45) Date of Patent: Nov. 6, 2018

(54) RECIPROCATING COMPRESSOR

(71) Applicant: LG ELECTRONICS INC., Seoul (KR)

(72) Inventor: Taemin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 398 days.

(21) Appl. No.: 14/991,478

(22) Filed: Jan. 8, 2016

(65) Prior Publication Data

US 2016/0222954 A1 Aug. 4, 2016

(30) Foreign Application Priority Data

Feb. 4, 2015 (KR) ..... 10-2015-0017246

(51) Int. Cl.
*F04B 39/12* (2006.01)
*F04B 39/00* (2006.01)

(52) U.S. Cl.
CPC ..... *F04B 39/0061* (2013.01); *F04B 39/121* (2013.01); *F04B 39/123* (2013.01)

(58) Field of Classification Search
CPC ..... F04B 39/0027; F04B 39/0055; F04B 39/0061; F04B 53/001; F04B 53/003; F04C 15/0049; F04C 29/0035; F04C 29/065; F04C 29/068
USPC ..... 417/312
See application file for complete search history.

(56) References Cited

U.S. PATENT DOCUMENTS

| | | | | |
|---|---|---|---|---|
| 7,435,061 | B2 * | 10/2008 | Lee | F04B 39/0061 181/403 |
| 7,758,318 | B2 * | 7/2010 | Yokota | F04B 39/0061 417/312 |
| 8,230,968 | B2 | 7/2012 | Jung et al. | |
| 2008/0219863 | A1 * | 9/2008 | Jung | F04B 39/0061 417/312 |
| 2010/0290928 | A1 * | 11/2010 | Jung | F04B 39/0055 417/312 |
| 2011/0014065 | A1 * | 1/2011 | Park | F04B 39/0061 417/312 |

(Continued)

FOREIGN PATENT DOCUMENTS

| | | |
|---|---|---|
| CN | 1292068 | 4/2001 |
| CN | 101260876 | 9/2008 |

(Continued)

OTHER PUBLICATIONS

Chinese Office Action (with Full English Translation) dated Jul. 21, 2017 issued in Application No. 201610073338.9.

*Primary Examiner* — Patrick Hamo
(74) *Attorney, Agent, or Firm* — Ked & Associates, LLP

(57) ABSTRACT

A reciprocating compressor is provided that may include a shell, a suction pipe coupled to the shell, a driver provided inside of the shell that generates a rotational force, a compression device including a connecting rod that converts the rotational force into a linear driving force, a piston coupled to the connecting rod, and a cylinder into which the piston is movably inserted, a suction muffler provided inside of the shell that reduces a pressure pulsation of a refrigerant suctioned through the suction pipe, and a suction guide that extends from the shell to the suction muffler and includes at least one protrusion that contacts an inner surface of the shell.

18 Claims, 7 Drawing Sheets

(56) References Cited

U.S. PATENT DOCUMENTS

| | | | | |
|---|---|---|---|---|
| 2011/0209941 | A1* | 9/2011 | Jung | F04B 39/0061<br>181/229 |
| 2013/0266459 | A1* | 10/2013 | Morishima | F04D 13/06<br>417/410.1 |
| 2015/0004014 | A1* | 1/2015 | Kim | F04B 39/0027<br>417/312 |
| 2015/0004025 | A1* | 1/2015 | Kang | F04B 49/225<br>417/415 |

FOREIGN PATENT DOCUMENTS

| | | |
|---|---|---|
| CN | 201437763 | 4/2010 |
| CN | 102197221 | 9/2011 |
| CN | 102292547 | 12/2011 |
| CN | 103362781 | 10/2013 |
| KR | 10-2010-0023285 | 3/2010 |
| KR | 10-2010-0044374 | 4/2010 |

* cited by examiner

RECIPROCATING COMPRESSOR

CROSS-REFERENCE TO RELATED APPLICATION

This application claims priority under 35 U.S.C. § 119 to Korean Patent Application No. 10-2015-0017246, filed in Korea on Feb. 4, 2015, whose entire disclosure is hereby incorporated by reference.

BACKGROUND

1. Field

A reciprocating compressor is disclosed herein.

2. Background

A reciprocating compressor is a device that compresses a fluid by suctioning and compressing a refrigerant through a reciprocating motion of a piston in a cylinder. The reciprocating compressor may be classified as a connection type reciprocating compressor or a vibration type reciprocating compressor according to a driving method of the piston. In the connection type reciprocating compressor, the refrigerant is compressed by a reciprocating motion of the piston, which is connected to a rotating shaft of a driver through a connecting rod in the cylinder. In the vibration type reciprocating compressor, the refrigerant is compressed by the reciprocating motion of the piston, which is connected to a movable element of a reciprocating motor so as to vibrate in the cylinder.

The connection type reciprocating compressor may include a shell that forms a closed space, a driving unit or driver provided in the shell to provide a driving force, a compression unit or device that connects to a rotating shaft of the driver and compresses the refrigerant using the driving force from the driver via the reciprocating motion of the piston in the cylinder, and a suction and discharge unit or device that suctions the refrigerant and discharges the refrigerant compressed by the reciprocating motion of the compression device.

A suction muffler that reduces flow noise or pressure pulsation, which may occur when the refrigerant is suctioned, may be installed at a suction side of the suction and discharge device. The refrigerant may be introduced into the housing shell through a suction pipe connected to the shell, and vibration and noise may be reduced while the refrigerant passes through the suction muffler.

A suction method may be classified as a direct suction method or an indirect suction method according to a connection between the suction pipe and the suction muffler. In the direct suction method, the suction pipe and the suction muffler are directly connected with each other. In the indirect suction method, the suction pipe and the suction muffler are spaced apart by a desired distance.

The indirect suction method may be advantageous in that wave energy of the refrigerant may be reduced through an internal volume of the shell. However, there may be a refrigerant insulation problem due to heat transfer with the refrigerant, and thus, refrigeration efficiency may degrade. The direct suction method may solve the refrigerant insulation problem, but as it is not easy to reduce wave energy, there may a problem in that pressure pulsation may increase.

Korean Patent Application No. 10-2010-044374 with publication date of Apr. 30, 2010 is related to a direct suction type suction muffler and is hereby incorporated by reference.

In Korean Patent Application No. 10-2010-044374, refrigerant is introduced via a direct suction method.

BRIEF DESCRIPTION OF THE DRAWINGS

Embodiments will be described in detail with reference to the following drawings in which like reference numerals refer to like elements, and wherein.

DETAILED DESCRIPTION

Figure 1:
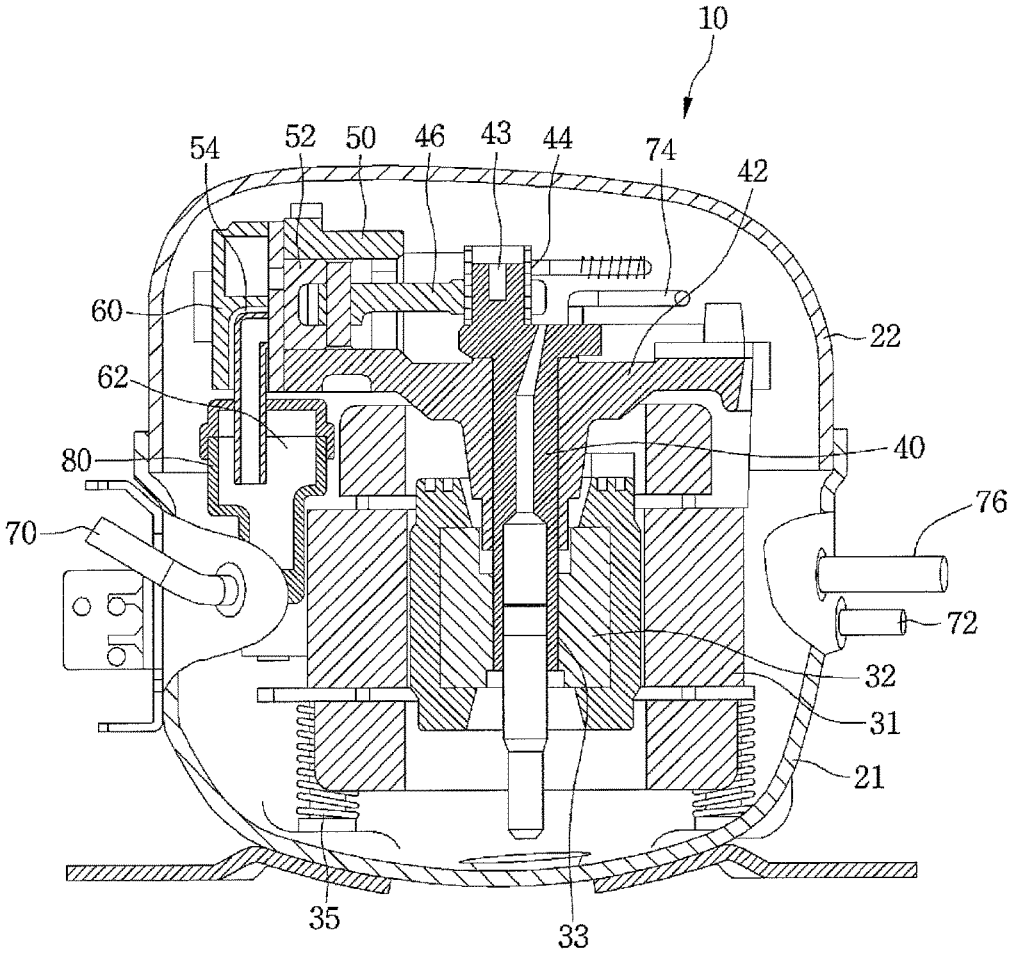
FIG. 1 is a front cross-sectional view of a reciprocating compressor according to an embodiment.
Figure 2:
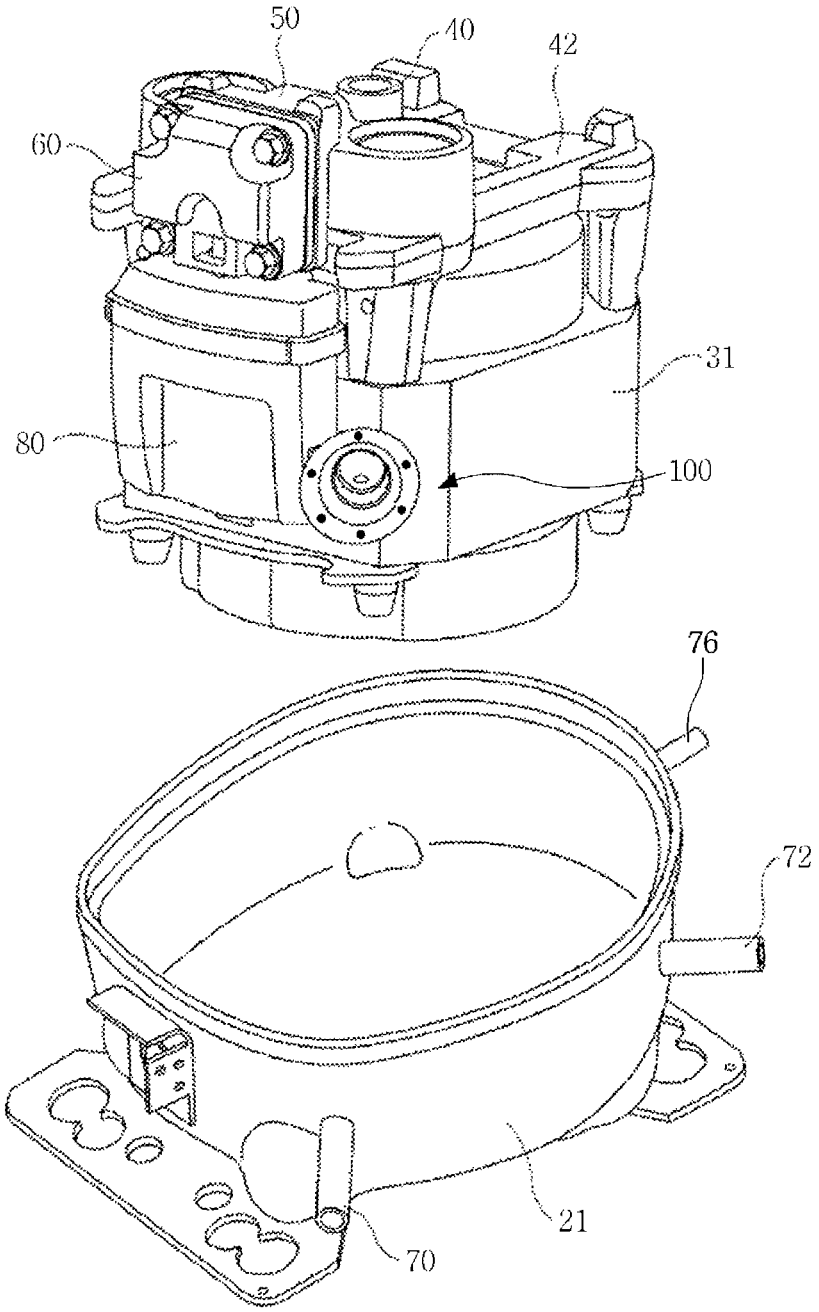
FIG. 2 is an exploded perspective view of the reciprocating compressor of FIG. 1.
Figure 3:
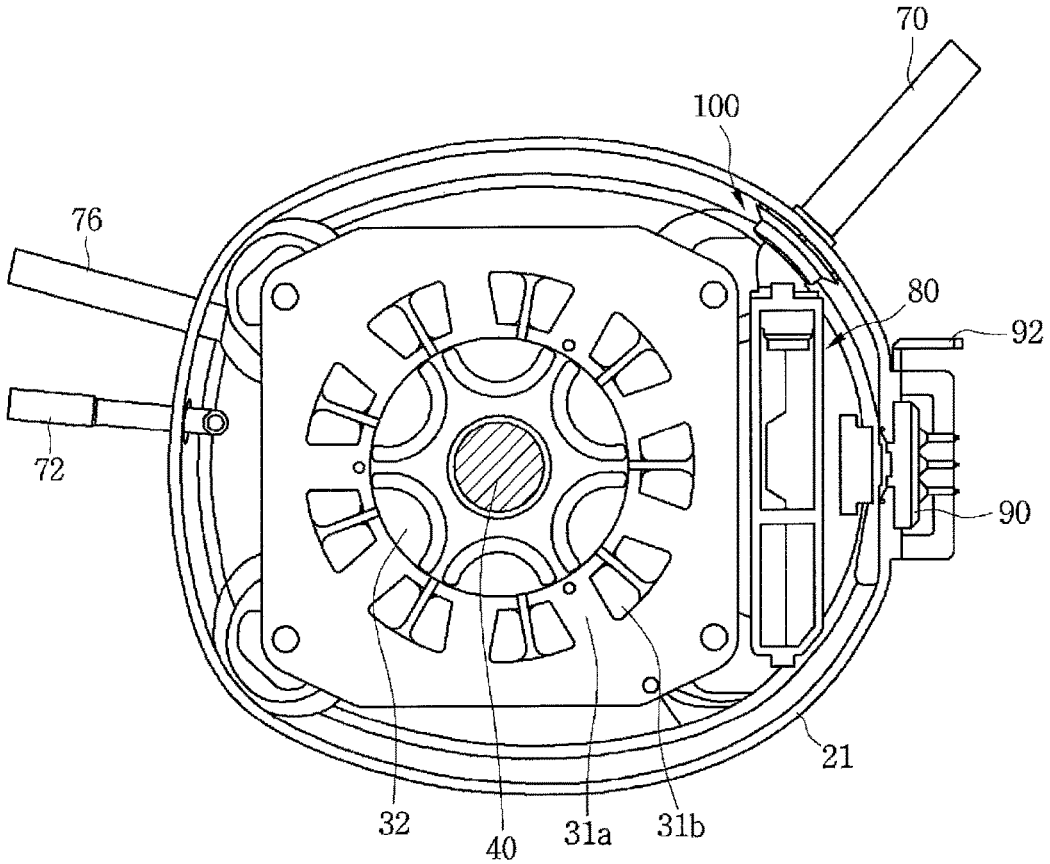
FIG. 3 is a plan cross-sectional view of the reciprocating compressor of FIG. 1.

FIG. 1 is a front cross-sectional view of a reciprocating compressor according to an embodiment. FIG. 2 is an exploded perspective view of the reciprocating compressor of FIG. 1. FIG. 3 is a plan cross-sectional view of the reciprocating compressor of FIG. 1.

Referring to FIGS. 1 to 3, a reciprocating compressor 10 according to an embodiment may include shells 21 and 22 that form an external appearance of the reciprocating compressor, a driver provided in an internal space of the shells 21 and 22 to provide a driving force, and a compression device that receives the driving force from the driver and compresses a refrigerant through a linear reciprocating motion.

The shells 21 and 22 may form a closed space, and various components that form the compressor 10 may be accommodated in the closed space. The shells 21 and 22 may be formed of a metallic material, for example, and may include a first shell 21 and a second shell 22.

The first shell 21 may be in a hemispherical shape and may form an accommodation space, which may accommodate the driver, the compression device, and various components that form the compressor 10. The first shell 21 may form the accommodation space together with the second shell 22. The first shell 21 may be referred to as, for example, a "compressor body". The second shell 22 may be referred to as, for example, a "compressor cover".

A suction pipe 70, a discharge pipe 72, a process pipe 76, and power supply parts or components 90 and 92 may be provided at or on the first shell 21. The suction pipe 70 may introduce the refrigerant into the shells 21 and 22 and may pass through the first shell 21. The suction pipe 70 may be separately provided at or on the first shell 21 or may be integrally formed with the first shell 21. The discharge pipe 72 may discharge the refrigerant compressed in the shells 21 and 22 and may pass through the first shell 21. The discharge pipe 72 may also be separately provided at or on the first shell 21 or may be integrally formed with the first shell 21. The process pipe 76 may be provided so as to fill the refrigerant into the shells 21 and 22 after an inside of the shells 21 and 22 is closed and may pass through the first shell 21.

A loop pipe 74 may be connected to the discharge pipe 72. The refrigerant introduced into the suction pipe 70 and compressed through the compression device may be discharged via the loop pipe 74 to the discharge pipe 72.

The second shell 22 may form the accommodation space with the first shell 21 and may have a hemispherical shape, for example, similar to the first shell 21. The second shell 22 may communicate with or contact an upper side of the first shell 21 to form the closed space.

The power supply parts or components 90 and 92 may include a terminal 90, to which electric power may be applied, and a bracket 92, which may be installed near the terminal 90 to protect the terminal 90.

The driver may include a stator 31, a rotor 32, and a rotating shaft 40. The stator 31 may be fixed while the driver is driven and may include a stator core 31*a* and a stator coil 31*b*. The stator core 31*a* may be formed of a metallic material, for example, and may be in a cylindrical shape which may be hollow inside.

The stator coil 31*b* may be provided inside of the stator core 31*a*. When electric power is applied, the stator coil 31*b* may generate an electromagnetic force and may electromagnetically interact with the stator core 31*a* and the rotor 32. Accordingly, the driver may generate a driving force for the linear reciprocating motion of the compression device.

A plurality of springs 35 may be provided at a lower side of the stator 31 to buffer against shock or vibrations which may be transmitted to the stator 31 when the rotor 32 is rotated. The rotor 32 may be rotatably provided inside of the stator core 31*a* to rotate while the driver is driven. The rotor 32 may include a magnet. When electric power is supplied from outside, the rotor 32 may be rotated by the electromagnetic interaction with the stator core 31*a* and the stator coil 31*b*. A rotational force due to rotation of the rotor 32 may serve as the driving force that drives the compression device.

The rotating shaft 40 may be rotated with the rotor 32 and may be provided in a fitting hole 33, which may longitudinally pass through a center of the rotor 32. The rotating shaft 40 may be rotatably inserted into a cylinder block 42. The rotating shaft 40 may include an eccentric part or portion 43, which may be provided at an upper portion of the rotating shaft 40 and also eccentrically provided at a main body of the rotating shaft 40 at a lower side thereof. The rotating shaft 40 may include a sleeve 44, which may be coupled to the eccentric portion 43. The sleeve 44 may surround at least a portion of an outer circumferential surface of the eccentric portion 43. A connecting rod 46 that converts rotational motion into linear motion may be coupled to the sleeve 44.

The compression device may include the cylinder block 42, the connecting rod 46, a cylinder 50, and a piston 52. The cylinder block 42 may be provided at an upper side of the rotor 32 and may be inside of the shells 21 and 22. The cylinder 50 may be provided at a side of an upper portion of the cylinder block 42 and may accommodate the piston 52. The piston 52 may be reciprocated in forward and backward directions in the cylinder 50, and a compression space, in which the refrigerant may be compressed, may be formed inside of the cylinder 50.

The cylinder 50 may be formed of an aluminum material, for example. For example, the cylinder 50 may be formed of aluminum or an aluminum alloy. As aluminum materials may not be magnetic, magnetic flux generated from or by the rotor 32 may not be transferred to the cylinder 50. Thus, magnetic flux generated from or by the rotor 32 may be prevented from being transferred to the cylinder 50 and leaking out of the cylinder 50.

The connecting rod 46 may transmit the driving force provided from or by the driver to the piston 52 and convert a rotational motion of the rotating shaft 40 into a linear reciprocating motion. For example, the connecting rod 46 may linearly reciprocate forward and backward when the rotating shaft 40 is rotated. The connecting rod 46 may be formed of a sintered alloy, for example.

The piston 52 may compress the refrigerant and may be accommodated in the cylinder 50 to reciprocate in the forward and backward directions. The piston 52 may be connected with the connecting rod 46. The piston 52 may perform the linear reciprocating motion in the cylinder 50 according to movement of the connecting rod 46. The refrigerant introduced from the suction pipe 70 may be compressed in the cylinder 50 by the linear reciprocating motion of the piston 52.

The piston 52 may also be formed of an aluminum material, such as, for example, aluminum or an aluminum alloy of the cylinder 50. Thus, magnetic flux generated from or by the rotor 32 may be prevented from leaking out through the piston 52.

The compressor 10 may further include a valve unit or valve 54, which may be provided at an opening of the cylinder 50 to suction or discharge a refrigerant gas into/from a compression space of the cylinder 50. The compressor 10 may further include a head cover 60, which may be provided at an outside of the valve 54 to provide a suction space and a discharge space, which may be divided from each other to separate a suction refrigerant from a discharge refrigerant.

The compressor 10 may further include a suction muffler 80, which may be provided at a lower side of the head cover 60 to communicate with the head cover 60. The suction muffler 80 may communicate with the suction pipe 70 through a suction guide 100. The suction guide device 100 may guide the refrigerant suctioned through the suction pipe 70 into the suction muffler 80.

The compressor 10 may further include a discharge muffler 62, which may be provided at an upper side of the head cover 60 to reduce noise from the discharge refrigerant. The discharge muffler 62 may communicate with the discharge pipe 72 and the loop pipe 74. For example, the suction muffler 80 and the discharge muffler 62 may be integrally formed with each other.

When electric power is applied through the terminal 90, the rotor 32 may be rotated by an interaction between the stator 31 and the rotor 32. The rotating shaft 40 coupled with the rotor 32 may also be rotated. The rotational motion of the rotating shaft 40 may be converted into the linear reciprocating motion by the connecting rod 46, and the piston 52 may linearly reciprocate in the compression space formed in the cylinder 50.

When the piston 52 is moved backward, the refrigerant suctioned through the suction pipe 70 may be introduced into the valve 54 through the suction muffler 80 and a suction space of the head cover 60. The refrigerant may be suctioned into the compression space formed in the cylinder 50 while a suction valve of the valve 54 is opened. When the piston 52 is moved forward, the refrigerant compressed in the compression space may be discharged to a discharge space of the head cover 60 while opening a discharge valve, may pass through the discharge muffler 62 and the loop pipe 74, and then may be discharged out of the shells 21 and 22 through the discharge pipe 72.

Figure 4:
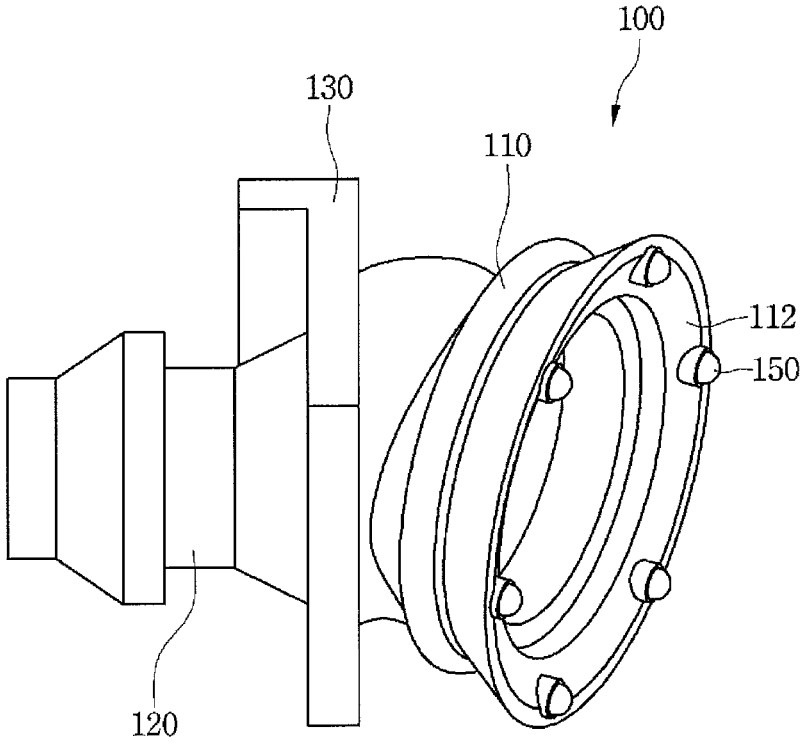
FIG. 4 is a perspective view of a structure of a suction guide unit or guide according to an embodiment.
Figure 5:
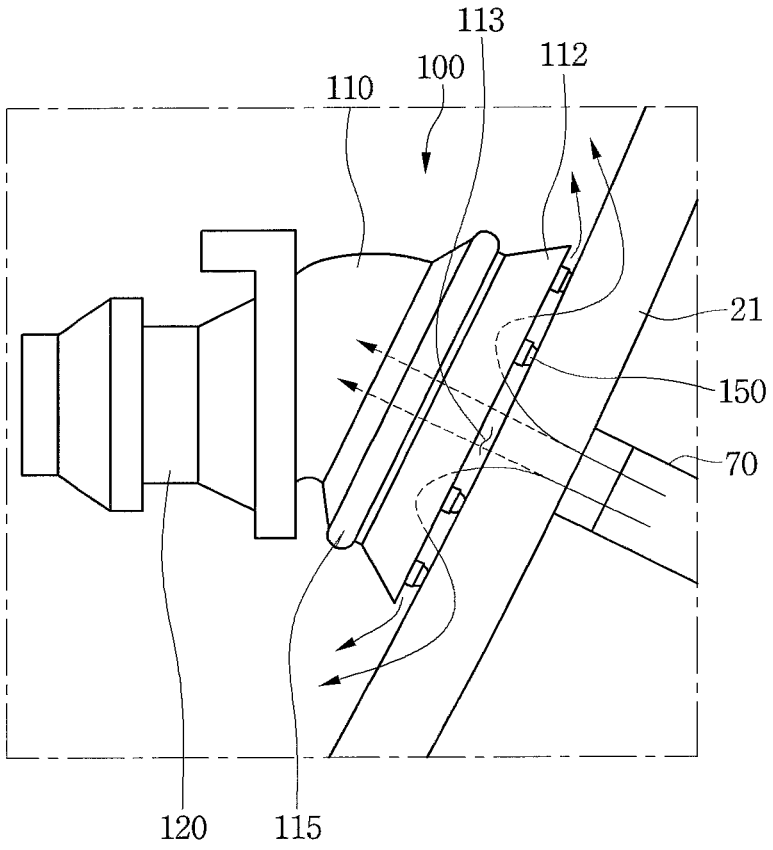
FIG. 5 is a view of a shell and the suction guide coupled according to an embodiment.
Figure 6:
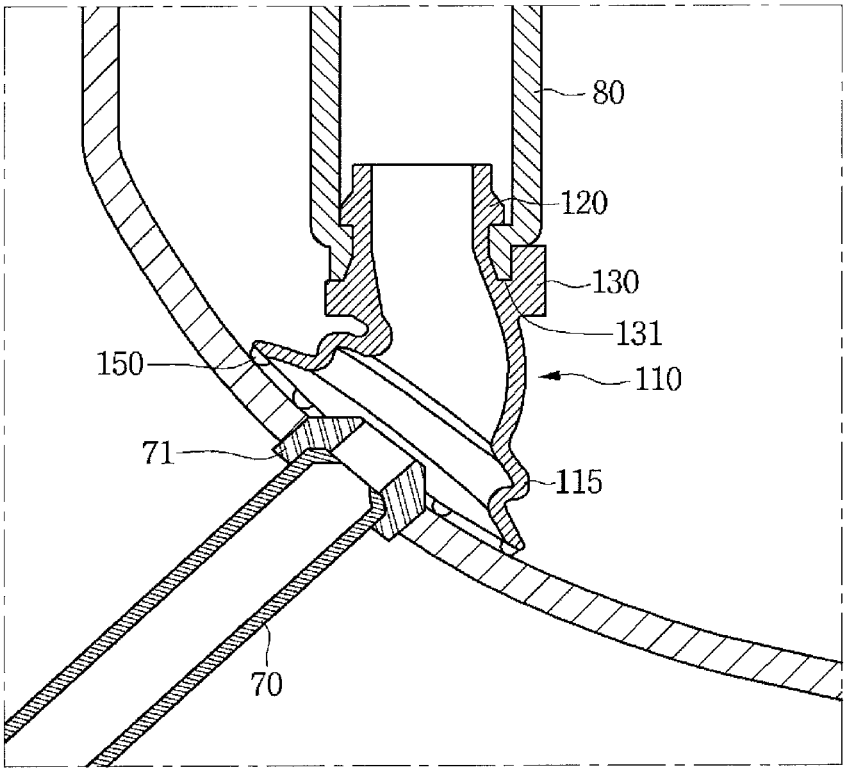
FIG. 6 is a cross-sectional view of the shell and the suction guide device coupled to the embodiment.

FIG. 4 is a perspective view of a structure of a suction guide unit or guide according to an embodiment. FIG. 5 is a view of a shell and the suction guide device coupled according to an embodiment. FIG. 6 is a cross-sectional view of the shell and the suction guide coupled according to an embodiment.

Referring to FIGS. 4 to 6, compressor 10 according to embodiments disclosed herein may include the suction pipe 70, which may be coupled to the shells 21 and 22 to guide suctioning of the refrigerant, and the suction muffler 80, which may be provided inside the shells 21 and 22 to transfer the refrigerant suctioned through the suction pipe 70 to the cylinder 50 and to reduce flow noise or pressure pulsation generated from the suctioned refrigerant.

The compressor 10 may further include the suction guide 100, which may extend from the shells 21 and 22 to the suction muffler 80 and guide the refrigerant suctioned through the suction pipe 70 to the suction muffler 80. The suction guide 100 may include a guide body 110 supported by an inner surface of the shells 21 and 22, a muffler insertion part or portion 120 coupled to an inside of the suction muffler 80, a support part or support 130 supported by an outer surface of the suction muffler 80, and a bellows 115.

The support 130 may protrude from an outer surface of the guide body 110 and restrict the guide body 110 from being moved into the suction muffler 80. For example, the support 130 may include a stopper 131 coupled to a portion of the suction muffler 80. The stopper 131 may be a groove formed at the support 130 and may accommodate the portion of the suction muffler 80. The portion of the suction muffler 80 may include an end of the suction muffler 80.

The guide body 110 may have a hollow cylindrical shape in which the refrigerant may flow and may be formed so that a cross section thereof may be gradually reduced from the inner surface of the shells 21 and 22 toward the suction muffler 80. The muffler insertion portion 120 may also have a hollow cylindrical shape in which the refrigerant may flow and may extend into the suction muffler 80 by a predetermined length. The guide body 110 and the muffler insertion portion 120 may be integrally formed with each other.

The guide body 110 may include the inner surface of the shells 21 and 22, for example, a front surface portion or front surface 112, which may face the first shell 21. The front surface 112 may be supported by the inner surface of the shells 21 and 22. The front surface 112 may be an end of the guide body 110 supported by the inner surface of the shells 21 and 22. The guide body 110 may be rounded from the front surface 112 toward the muffler insertion portion 120 with a predetermined curvature.

A plurality of protrusion portions or protrusions 150, which may contact the inner surface of the shells 21 and 22, may be provided at the front surface 112. For example, as shown in FIG. 4, six protrusions 150 may be provided, however, embodiments are not limited thereto. The plurality of protrusions 150 may be spaced apart from each other at regular intervals along a boundary of the front surface 112.

The plurality of protrusions 150 may closely contact the inner surface of the shells 21 and 22 and may protrude from the front surface 112 toward the inner surface of the shells 21 and 22 by a predetermined length. For example, the predetermined length may be in a range of about 0.8 mm to about 1.2 mm.

Each of the plurality of protrusions 150 may have a spherical or hemispherical shape. If each protrusion 150 has the spherical or hemispherical shape, the protrusion 150 may be stably supported by the shells 21 and 22, and thus, a contact area between the protrusion 150 and the shells 21 and 22 may be small. Also, a space between the front surface 112 and the shells 21 and 22 may be sufficiently secured and correspond to a length of the respective protrusion 150.

As the plurality of protrusions 150 protruding from the front surface 112 may be in close contact with the inner surface of the shells 21 and 22, the front surface 112 may be spaced from the inner surface of the shells 21 and 22. That is, the plurality of protrusions 150 may be provided between the front surface 112 and the inner surface of the shells 21 and 22.

A space portion or space 113, which may enable the refrigerant suctioned through the suction pipe 70 to flow to the internal space of the shells 21 and 22, may be provided between the front surface 112 or the guide body 110 and the inner surface of the shells 21 and 22. The space 113 may be defined by the front surface 112 and two of the plurality of protrusions 150. A number of the spaces 113 may correspond to a number of the plurality of protrusions 150. For example, when two protrusions 150 are provided, two spaces 113 may be formed, and when six protrusions 150 are provided, six spaces 113 may be formed.

As shown in FIG. 5, the refrigerant suctioned into the shells 21 and 22 through the suction pipe 70 may flow and spread from the inner surface of the shells 21 and 22 into the internal space of the shells 21 and 22 through the space 113. Thus, as the refrigerant flows, a wave energy or a pressure pulsation of the refrigerant may be reduced through the internal space of the shells 21 and 22. As the suction guide 100 may be spaced away from the inner surface of the shells 21 and 22, vibration of the shells 21 and 22 transferred to the suction guide 100 may be reduced.

Even though the guide body 110 is spaced apart from the inner surface of the shells 21 and 22, the guide body 110 may be spaced apart only by the length of the protrusion 150. That is, the guide body 110 may be at a position which may be spaced very close to the inner surface of the shells 21 and 22. Accordingly, reduction of refrigeration efficiency, which may occur in a conventional indirect suction method due to heat transfer between a suction refrigerant and a high temperature refrigerant in a shell, may be prevented.

The compressor 10 may further include a pipe connection part or connector 71 that couples the suction pipe 70 to the shells 21 and 22. The pipe connector 71 may be coupled to an outer side of the suction pipe 70 and may pass through the shells 21 and 22. At least a portion of the pipe connector 71 may protrude inward from the inner surface of the shells 21 and 22. For example, an end of the pipe connector 71 that protrudes inward from the inner surface of the shells 21 and 22 may be positioned inside of the guide body 110. Thus, the refrigerant suctioned through the suction pipe 70 may be easily guided into the suction guide 100 while passing through the pipe connector 71, and the suction pipe 70 may be stably coupled to the shells 21 and 22 by the pipe connector 71.

Figure 7:
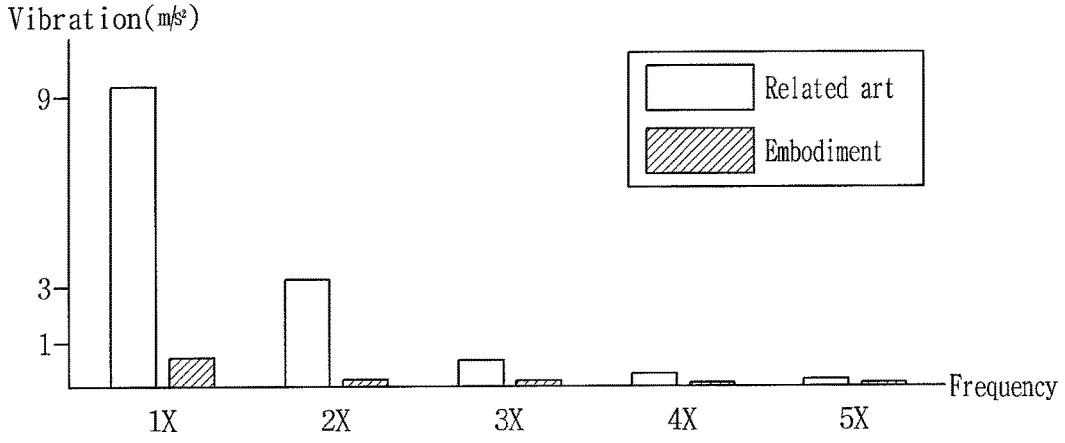
FIG. 7 is a graph of a reduction effect on pressure pulsation by the suction guide device according to the embodiment.

FIG. 7 is a graph of a reduction effect on pressure pulsation by a suction guide according to embodiments disclosed herein. As shown in FIG. 7, there is a difference in pressure pulsation between when the suction guide 100 according to embodiments disclosed herein is installed at the shells 21 and 22 and when a suction guide is installed according to a direct suction method of the related art. In the related art, an entire front surface of a suction guide may contact an inner surface of a shell, that is, the suction guide of the related art may not be spaced apart from the inner surface of the shell.

In the graph of FIG. 7, a frequency of 25 Hz is used, and a horizontal axis of the graph indicates a frequency component. A vertical axis of the graph of FIG. 7 indicates a vibration value generated according to a pressure pulsation. For example, 1× on the horizontal axis is a synchronous frequency component, which indicates a one-time component of a rotating speed of a compressor, and a vibration value that corresponds to the 1× frequency position is indicated on the vertical axis. Additionally, 2×, 3×, 4× and 5×, for example, indicate two-time, three-time, four-time, and five-time frequency components, respectively. As shown in the graph of FIG. 7, when the suction guide according to embodiments disclosed herein is applied to the compressor, the vibration according to the pressure pulsation is smaller than the vibration according to the pressure pulsation in the related art with respect to all of the frequency values.

According to another embodiment disclosed herein, at least one protrusion may be provided at an inner surface of a shell rather than provided at a suction guide as in previous embodiments. The suction guide that guides the flow of the refrigerant according to another embodiment may be provided between a suction pipe and a suction muffler so as to be very close to the inner surface of the shell.

For example, when the at least one protrusion, which may contact the inner surface of the shells, is provided at the suction guide and a body of the suction guide is spaced apart from the inner surface of the shell, it may be possible to obtain advantages of the direction suction method and the indirect suction method of a conventional suction muffler.

That is, if the suction guide is supported by the inner surface of the shell while the body of the suction guide is spaced apart from the inner surface of the shell, a pressure pulsation of a refrigerant may be reduced as the refrigerant flows to the shell. Accordingly, vibration of the shell may also be prevented from being transferred to the suction guide. Due to reduced pressure pulsation, noise generated when the compressor is operated may be reduced.

As a distance between the body of the suction guide and the shells is very short, a small heat transfer between the refrigerant introduced through the suction pipe and the refrigerant in the shells may be minimized and refrigeration efficiency may be improved. As a bellows may be provided at or in the suction guide, the suction guide may be stably supported by the shells, and vibration or shock generated while the compressor is driven may be mitigated.

Embodiments disclosed herein provide a reciprocating compressor that may reduce a pressure pulsation occurring while a refrigerant is suctioned.

Embodiments disclosed herein provide a reciprocating compressor that may include a shell to which a suction pipe may be coupled; a driving unit or driver installed inside of the shell and configured to generate a rotational force, a compression unit or device having a connecting rod configured to convert the rotational force into a linear driving force, a piston connected to the connecting rod, and a cylinder in which the piston may be movably inserted, a suction muffler configured to reduce a pressure pulsation of a refrigerant suctioned through the suction pipe, and a suction guide unit or guide configured to extend from the shell to the suction muffler, and having a protrusion portion or protrusion, which may be in contact with an inner surface of the shell. The suction guide according to embodiments disclosed herein may further include a guide body that has a front surface portion or front surface facing an inner surface of the shell and a muffler insertion part or portion that extends into the suction muffler.

The protrusion portion or protrusion according to embodiments disclosed herein may be installed at the front surface. The protrusion portion or protrusion may be installed at a boundary of the front surface. The protrusion portion or protrusion may have a spherical or hemispherical shape.

A plurality of protrusion portions may be installed to be spaced apart from each other. A plurality of space portions or spaces may be formed corresponding to the number of the plurality of protrusion portions.

The reciprocating compressor according to embodiments disclosed herein may further include a space portion or space, which may be defined by the front surface and the plurality of protrusion portions and may guide the refrigerant suctioned through the suction pipe into the shell.

The suction guide unit may further include a support part or support, which may be provided at an outer surface of the guide body and supported by the suction muffler and which may have a stopper that restricts the guide body from being moved into the suction muffler. The front surface may include an end of the guide body, which may be supported by the inner surface of the shell.

The suction guide unit may further include a pipe connection part or portion coupled to an outer side of the suction pipe and disposed or provided to pass through the shell. At least a part or portion of the pipe connection part or connector may protrude inward from the inner surface of the shell, and an end of the pipe connection part or connector may be located or provided inside the guide body.

Embodiments disclosed herein further provide a reciprocating compressor that may include a shell, to which a suction pipe may be coupled, a driving unit or driver installed inside of the shell and configured to generate a rotational force, a compression unit or device having a connecting rod configured to convert the rotational force into a linear driving force, a piston connected to the connecting rod, and a cylinder in which the piston may be movably inserted, a suction muffler installed inside of the shell and configured to transfer a refrigerant suctioned through the suction pipe to the cylinder, and a suction guide unit or guide coupled to the suction muffler and configured to transfer the refrigerant suctioned through the suction pipe to the suction muffler. The suction guide may include a guide body, which may be spaced apart from an inner surface of the shell, and a protrusion portion or protrusion, which may be provided between the guide body and the inner surface of the shell. A plurality of protrusion portions or protrusions may be provided at a front surface of the guide body. The reciprocating compressor according to embodiments disclosed herein may further include a space portion or space which may be defined by the front surface and the plurality of protrusion portions and may guide the refrigerant suctioned through the suction pipe into the shell.

The suction guide unit may further include a muffler insertion portion that extends into the suction muffler, and a support part or support, which may be provided at the guide body and supported by an outer side of the suction muffler. The protrusion portion or protrusion may protrude from the front surface toward the inner surface of the shell by a predetermined length and may be in close contact with the inner surface of the shell. The predetermined length may be formed within a range of about 0.8 mm to about 1.2 mm. The guide body may have a hollow cylindrical shape in which the refrigerant may flow and may be formed so that a cross section thereof may be gradually reduced from the inner surface of the shell toward the suction muffler.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A reciprocating compressor, comprising:
- a shell;
- a suction pipe coupled to the shell;
- a driver provided inside of the shell that generates a rotational force;
- a compression device including:
  - a connecting rod that converts the rotational force into a linear driving force;
  - a piston coupled to the connecting rod; and
  - a cylinder into which the piston is movably inserted;
  - a suction muffler provided inside of the shell that reduces a pressure pulsation of a refrigerant suctioned through the suction pipe; and
  - a suction guide that extends from the shell to the suction muffler, the suction guide including:
    - a guide body having a front surface that faces an inner surface of the shell, the front surface being spaced apart from the inner surface of the shell;
    - a plurality of protrusions that protrudes from the front surface of the guide body and contacts the inner surface of the shell, the plurality of protrusions being spaced apart from each other; and
    - a space defined by the front surface and the plurality of protrusions and through which the refrigerant suctioned through the suction pipe flows into the inside of the shell.

2. The reciprocating compressor according to claim 1, wherein the suction guide further includes
- a muffler insertion portion that extends towards an inside of the suction muffler.

3. The reciprocating compressor according to claim 1, wherein a number of a plurality of spaces correspond to a number of the plurality of protrusions.

4. The reciprocating compressor according to claim 1, wherein at least one of the plurality of protrusions has a spherical or hemispherical shape.

5. The reciprocating compressor according to claim 1, wherein the suction guide further includes a support provided at an outer surface of the guide body and supported by the suction muffler, and wherein the support includes a stopper that restricts the guide body from moving into the suction muffler.

6. The reciprocating compressor according to claim 1, further including a pipe connector that couples to an outer side of the suction pipe and that passes through the shell.

7. The reciprocating compressor according to claim 6, wherein at least a portion of the pipe connector protrudes inward from the inner surface of the shell, and wherein an end of the pipe connector is provided inside of the guide body.

8. A reciprocating compressor, comprising:
- a shell;
- a suction pipe coupled to the shell;
- a driver provided inside of the shell that generates a rotational force;
- a compression device including:
  - a connecting rod that converts the rotational force into a linear driving force;
  - a piston coupled to the connecting rod; and
  - a cylinder in which the piston is movably inserted;
- a suction muffler provided inside of the shell that transfers a refrigerant suctioned through the suction pipe to the cylinder; and
- a suction guide coupled to the suction muffler that transfers the refrigerant suctioned through the suction pipe to the suction muffler, wherein the suction guide device includes:
  - a guide body including a front surface spaced apart from an inner surface of the shell;
  - a plurality of protrusions provided between the front surface and the inner surface of the shell, the plurality of protrusions protruding from the front surface and contacting the front surface of the guide body; and
  - a space defined by the front surface and the plurality of protrusions and through which the refrigerant suctioned through the suction pipe flows into the inside of the shell.

9. The reciprocating compressor according to claim 8, wherein the suction guide further includes:
- a muffler insertion portion that extends towards an inside of the suction muffler; and
- a support provided at the guide body and supported by an outer side of the suction muffler.

10. The reciprocating compressor according to claim 8, wherein at least one of the plurality of protrusions protrudes from the front surface toward the inner surface of the shell by a predetermined length and contacts the inner surface of the shell, and wherein the predetermined length is formed within a range of about 0.8 mm to about 1.2 mm.

11. The reciprocating compressor according to claim 8, wherein the guide body has a hollow cylindrical shape in which the refrigerant flows.

12. The reciprocating compressor according to claim 11, wherein the guide body has a cross section which is gradually reduced from the inner surface of the shell towards the suction muffler.

13. A reciprocating compressor, comprising:
- a first shell;
- a second shell that forms a closed space with the first shell;
- a suction pipe coupled to the first shell;
- a driver provided inside of the closed space that generates a rotational force;
- a compression device including:
  - a connecting rod that converts the rotational force into a linear driving force;
  - a piston coupled to the connecting rod; and
  - a cylinder in which the piston is movably inserted;
- a suction muffler provided inside of the closed space that transfers a refrigerant suctioned through the suction pipe to the cylinder; and a suction guide coupled to the suction muffler that transfers the refrigerant suctioned through the suction pipe to the suction muffler, wherein the suction guide includes:

a guide body including a front surface spaced apart from an inner surface of the first shell;

a plurality of protrusions provided between the front surface and the inner surface of the first shell, the plurality of protrusions protruding from and contacting the front surface of the guide body; and a space defined by the front surface and the plurality of protrusions and through which the refrigerant suctioned through the suction pipe flows into the inside of the closed space.

14. The reciprocating compressor according to claim 13, wherein the second shell contacts an upper side of the first shell to form the closed space.

15. The reciprocating compressor according to claim 13, wherein the suction guide further includes:

a muffler insertion portion that extends towards an inside of the suction muffler; and a support provided at the guide body and supported by an outer side of the suction muffler.

16. The reciprocating compressor according to claim 13, wherein the cylinder and the piston are formed of an aluminum material.

17. The reciprocating compressor according to claim 13, wherein the guide body has a hollow cylindrical shape in which the refrigerant flows.

18. The reciprocating compressor according to claim 17, wherein the guide body has a cross section which is gradually reduced from the inner surface of the first shell towards the suction muffler.

* * * * *